United States Patent [19]

Greenwood

[11] 4,277,324

[45] Jul. 7, 1981

[54] TREATMENT OF PITCHES IN CARBON ARTIFACT MANUFACTURE

[75] Inventor: Sydney H. Greenwood, Sarnia, Canada

[73] Assignee: Exxon Research & Engineering Co., Florham Park, N.J.

[21] Appl. No.: 29,760

[22] Filed: Apr. 13, 1979

[51] Int. Cl.[3] ..... C10C 1/18; C10C 3/08

[52] U.S. Cl. ..... 208/45; 208/96; 208/309; 208/39; 423/447.4; 264/292; 264/DIG. 19

[58] Field of Search ..... 208/45, 96, 309, 22, 208/39; 423/447.4

[56] References Cited

U.S. PATENT DOCUMENTS

| | | | |
|---|---|---|---|
| 2,955,079 | 10/1960 | Foley | 208/45 |
| 2,980,602 | 4/1961 | Garwin | 208/45 |
| 3,364,138 | 1/1968 | Campagne et al. | 208/45 |
| 3,490,586 | 1/1970 | Jaisle | 208/45 |
| 3,595,946 | 7/1971 | Joo et al. | 423/447.6 |
| 3,668,110 | 6/1972 | Shea et al. | 208/45 |
| 4,055,183 | 1/1977 | Singer | 208/45 |
| 4,055,583 | 10/1977 | Holling et al. | 208/45 |
| 4,116,815 | 9/1978 | Sunago et al. | 208/87 |
| 4,127,472 | 11/1978 | Migitaka et al. | 208/45 |
| 4,184,942 | 1/1980 | Angier et al. | 208/45 |
| 4,208,267 | 6/1980 | Diefendorf et al. | 208/45 |

*Primary Examiner*—Brian E. Hearn
*Attorney, Agent, or Firm*—Joseph J. Dvorak

[57] ABSTRACT

Isotropic carbonaceous pitches are fluxed with an organic liquid thereby providing a fluid pitch which has substantially all of the quinoline insoluble material suspended in the pitch and which quinoline insoluble material is readily separable from the fluid pitch by filtration, centrifugation and the like. Thereafter the pitch is treated with an anti-solvent so as to precipitate at least a substantial portion of the pitch free of the quinoline insoluble solids.

16 Claims, 2 Drawing Figures

TREATMENT OF PITCHES IN CARBON ARTIFACT MANUFACTURE

FIELD OF THE INVENTION

The subject invention is concerned generally with the preparation of a feedstock for carbon artifact manufacture from carbonaceous residues of petroleum origin including distilled or cracked residuums of crude oil and hydrodesulfurized residues of distilled or cracked crude oil. More particularly, the invention is concerned with the treatment of carbonaceous graphitizable petroleum pitches to obtain a feedstock eminently suitable for carbon fiber production.

DESCRIPTION OF THE PRIOR ART

Carbon artifacts have been made by pyrolyzing a wide variety of organic materials. One carbon artifact of commercial interest today is carbon fiber. Hence, particular reference is made herein to carbon fiber technology. Nonetheless, it should be appreciated that this invention has applicability to carbon artifact formation generally and, most particularly, to the production of shaped carbon articles in the form of filaments, yarns, ribbons, films and sheets and the like.

Referring now in particular to carbon fibers, suffice it to say that the use of carbon fibers in reinforcing plastic and metal matrices has gained considerable commercial acceptance where the exceptional properties of the reinforcing composite materials such as their high strength-to-weight ratios clearly offset the generally high costs associated with preparing them. It is generally accepted that large scale use of carbon fibers as a reinforcing material would gain even greater acceptance in the marketplace if the costs associated with the formation of the fibers could be substantially reduced. Thus, the formation of carbon fibers from relatively inexpensive carbonaceous pitches has received considerable attention in recent years.

Many carbonaceous pitches are known to be converted at the early stages of carbonization to a structurally ordered, optically anisotropic spherical liquid called mesophase. The presence of this ordered structure prior to carbonization is considered to be a significant determinant of the fundamental properties of any carbon artifact made from such a carbonaceous pitch. The ability to generate high optical anisotropicity during processing is generally accepted, particularly in carbon fiber production, as a prerequisite to the formation of high quality products. Thus, one of the first requirements of any feedstock material suitable for carbon fiber production is its ability to be converted to a highly optically anisotropic material.

As is well known, pitches typically include insoluble and infusable materials which are insoluble in organic solvents such as quinoline or pyridine. These insoluble materials, commonly referred to as quinoline insolubles, normally consist of coke, carbon black, catalyst fines and the like. In carbon fiber production, it is necessary, of course, to extrude the pitch through a spinnerette having very fine orifices. Consequently, the presence of any quinoline insoluble material is highly undesirable since it can plug or otherwise foul the spinnerette during fiber formation.

Additionally, since many carbonaceous pitches have relatively high softening points, incipient coking frequently occurs in such materials at temperatures where they exhibit sufficient viscosity for spinning. The presence of coke and other infusable materials and/or undesirably high softening point components generated prior to or at the spinning temperatures are detrimental to processability and product quality. Moreover, a carbonaceous pitch or feedstock for carbon fiber production must have a relatively low softening point or softening point range and a viscosity suitable for spinning the feedstock into fibers. Finally, the feedstock must not contain components which are volatile at spinning or carbonization temperatures since such components also are detrimental to product quality.

Significantly, it has recently been discovered that typical graphitizable carbonaceous pitches contain a separable fraction which possesses very important physical and chemical properties insofar as carbon fiber processing is concerned. Indeed, this separable fraction of typical graphitizable carbonaceous pitches exhibits a softening range and viscosity suitable for spinning and has the ability to be converted rapidly at temperatures in the range generally of about 230° C. to about 400° C. to an optically anisotropic deformable pitch containing greater than 75% of a liquid crystal type structure. Since this highly oriented optically anisotropic pitch material formed from a fraction of an isotropic carbonaceous pitch has substantial solubility in pyridine and quinoline, it has been named neomesophase to distinguish it from the pyridine and quinoline insoluble liquid crystal materials long since known and referred to in the prior art as mesophase. The amount of this separable fraction of pitch present in well-known commercially available graphitizable pitches, such as Ashland 240 and Ashland 260, to mention a few, is relatively low. For example, with Ashland 240, no more than about 10% of the pitch constitutes a separable fraction capable of being thermally converted to neomesophase. Thus, there remains a need for a feedstock which is capable of being extruded into a fiber at temperatures below about 400° C. and which during heating will be converted rapidly into an optically anisotropic carbonaceous pitch, or at least prior to carbonization, and preferably prior to and/or during spinning.

SUMMARY OF THE INVENTION

It now has been discovered that quinoline insoluble substances and other undesirable high softening point components present in isotropic carbonaceous feedstocks, and particularly isotropic carbonaceous graphitizable pitches, can be readily removed by fluxing the feedstock with an organic solvent thereby providing a fluid pitch having substantially all of the quinoline insoluble material of the pitch suspended in the fluid in the form of a readily separable solid.

Broadly speaking, then, the present invention contemplates a process for treating an isotropic carbonaceous graphitizable pitch with an organic fluxing liquid to provide a fluid pitch which has suspended therein substantially all of the quinoline insoluble material in the pitch and which solid material is readily separable by filtering, centrifugation and the like. Thereafter, the fluid pitch is treated with an antisolvent compound so as to precipitate at least a substantial portion of the pitch free of quinoline insoluble solids.

The fluxing compounds suitable in the practice of the present invention include tetrahydrofuran, toluene, light aromatic gas oil, heavy aromatic gas oil, tetralin and the like when used in the ratio, for example, of from about 0.5 parts by weight of fluxing compound per weight of pitch to about 3 parts by weight of fluxing compound per weight of pitch. Preferably the weight ratio of fluxing compound to pitch is in the range of about 1:1 to about 2:1.

Among the anti-solvents suitable in the practice of the present invention are those solvents in which isotropic carbonaceous pitches are relatively insoluble and such anti-solvent substances include aliphatic and aromatic hydrocarbons such as heptane and the like. For reasons which are described hereinafter in greater detail, it is particularly preferred that the anti-solvent employed in the practice of the present invention have a solubility parameter of between about 8.0 and 9.5 at 25° C.

These and other embodiments of the present invention will be more readily understood from the following detailed description, particularly when read in conjunction with the accompanying drawings.

DETAILED DESCRIPTION OF THE INVENTION

Figure 1:
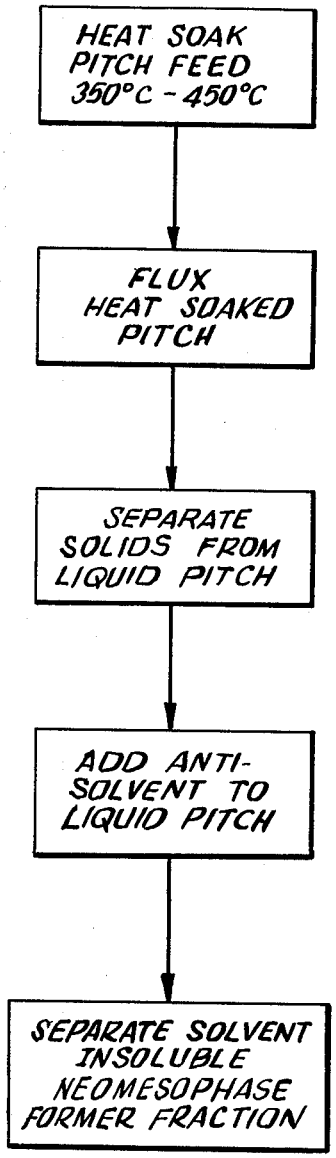
FIG. 1 is a flow plan illustrating the preferred process of the present invention.

The term "pitch" as used herein means petroleum pitches, natural asphalt and pitches obtained as by-products in the naphtha cracking industry, pitches of high carbon content obtained from petroleum, asphalt and other substances having properties of pitches produced as by-products in various industrial production processes.

The term "petroleum pitch" refers to the residuum carbonaceous material obtained from the thermal and catalytic cracking of petroleum distillates including a hydrodesulfurized residuum of distilled and cracked crude oils.

Generally pitches having a high degree of aromaticity are suitable for carrying out the present invention. Indeed, aromatic carbonaceous pitches having high aromatic carbon contents of from about 75% to about 90% as determined by nuclear magnetic resonance spectroscopy are generally useful in the process of this invention. So, too, are high boiling, highly aromatic streams containing such pitches or that are capable of being converted into such pitches.

On a weight basis, the useful pitches will have from about 88% to about 93% carbon and from about 7% to about 5% hydrogen. While elements other than carbon and hydrogen, such as sulfur and nitrogen, to mention a few, are normally present in such pitches, it is important that these other elements do not exceed 4% by weight of the pitch, and this is particularly true when forming carbon fibers from these pitches. Also, these useful pitches typically will have a number average molecular weight of the order of about 300 to 4,000.

Those petroleum pitches which are well-known graphitizable pitches meeting the foregoing requirements are preferred starting materials for the practice of the present invention. Thus, it should be apparent that carbonaceous residues of petroleum origin, and particularly isotropic carbonaceous petroleum pitches which are known to form mesophase in substantial amounts, for example in the order of 75% to 95% by weight and higher, during heat treatment at elevated temperatures, for example in the range of 350° C. to 450° C., are especially preferred starting materials for the practice of the present invention.

As stated above, it has been recently discovered that pitches of the foregoing type have a solvent insoluble separable fraction which is referred to as a neomesophase former fraction, or NMF fraction, which is capable of being converted to an optically anisotropic pitch containing greater than 75% of a highly oriented liquid crystalline material referred to as neomesophase. Importantly, the NMF fraction, and indeed the neomesophase itself, has sufficient viscosity at temperatures in the range, for example, of 230° C. to about 400° C., such that it is capable of being spun into pitch fiber. The amount of neomesophase former fraction of the pitch tends, however, to be relatively low. Thus, for example, in a commercially available graphitizable isotropic carbonaceous pitch such as Ashland 240, no more than about 10% of the pitch constitutes a separable fraction capable of being thermally converted to neomesophase.

In copending patent application Ser. No. 903,171, filed May 5, 1978, it has been disclosed that the heat soaking of isotropic carbonaceous petroleum pitches at temperatures in the range of about 350° C. to 450° C. results in an increase in that fraction of the pitch which is capable of being converted to neomesophase. Heat treatment normally is conducted to the point at which spherules can be observed visually under polarized light at a magnification factor of from 10× to 1,000×. Heating of such pitches tends to result in the generation of additional solvent insoluble solids, both isotropic and anisotropic, having significantly higher softening points and viscosities which are generally not suitable for spinning and which are not readily separable from the neomesophase former fraction of the pitch. The present invention overcomes this difficulty.

In accordance with the practice of the present invention, it is optional, although particularly desirable as is shown in the flow plan of FIG. 1, to heat soak an isotropic carbonaceous petroleum pitch at temperatures in the range of about 350° C. to 450° C. at least until spherules visible under polarized light at a magnification factor of from 10X to 1,000X begin to appear in the pitch. Indeed, for the purpose of evaluating the period of time in which heat soaking should continue, the optical anisotropy of the pitch need not be performed by the conventional technique of observing polished samples of appropriately heated pitch fractions by polar light microscopy, but rather a simplified technique of observing the optical activity of crushed samples of the pitch can be employed. Basically, this simplified technique requires placing a small sample of the heat soaked pitch on a slide with a histiological mounting medium such as the histiological mounting medium sold under the trade name Permount by Fisher Scientific Company, Fairlawn, N.J. A slip cover is then placed on top of the mounted sample which is thereafter crushed between the slide and cover to provide an even dispersion of material for viewing under polarized light. The appearance of spherules in the crushed sample which are visible under polarized light is a sufficient indication that heat soaking is adequate. Optionally, heat soaking of the pitch can continue for longer periods of time; however, prolonged heating does result occasionally in formation of additional insoluble fractions which, although separable by the process of the present invention, do not enhance the overall yield of the desired carbon fiber feedstock.

Optionally, an inert stripping gas such as nitrogen, natural gas and the like can be used during heat soaking to assist in the removal of lower molecular weight and volatile substances from the pitch if the pitch employed contains considerable quantities of materials volatile at temperatures up to 340° C. For pitches that do not contain significant amounts of volatile materials such as residual oils, purging the pitch with a stripping gas generally is not desirable.

After heat soaking for the requisite time period, the heat soaked product is mixed with an organic fluxing liquid. As used herein, the term "organic fluxing liquid" refers to an organic solvent which is nonreactive toward the carbonaceous graphitizable pitch and which, when mixed with the pitch in sufficient amounts, will render the pitch sufficiently fluid so that it can be easily handled and which causes substantially all of the quinoline insoluble fraction of the pitch to be suspended in the fluid pitch. Typical organic fluxing liquids suitable in the practice of the present invention include tetrahydrofuran, light aromatic gas oils, heavy aromatic gas oils, toluene and tetralin. As should be readily appreciated, the amount of organic fluxing liquid employed will vary depending upon the temperature at which the mixing is conducted and, indeed, depending upon the composition of the pitch itself. As a general guide, however, the amount of organic fluxing liquid employed will be in the range of about 0.5 parts by weight of organic liquid per part by weight of pitch to 3 parts by weight of organic liquid per part by weight of pitch. Preferably the weight ratio of flux to pitch will be in the range of from 1:1 to 2:1. The desirable ratio of fluxing liquid to pitch can be determined very quickly on a sample of the pitch by measuring the amount of fluxing liquid required to lower the viscosity of the pitch sufficiently at the desired temperature and pressure conditions that the pitch will be able to flow through a half micron filter generally with suction filtration; however, filtration under pressure can be used to advantage if the fluxing liquid is very volatile. As a further example, it has been found that one part by weight of tetrahydrofuran per part by weight of heat soaked Ashland 240 is sufficient to render the pitch sufficiently fluid at ambient temperatures and to result in the suspension of all of the quinoline insoluble materials in the pitch. On the other hand, in the case of toluene, the ratio of toluene on a weight basis to pitch will be about 0.5 to 1 to 1 when the pitch and toluene are heated at refluxing toluene temperature (B.P. 110° C.).

After fluxing the pitch in such a manner as to provide that substantially all the quinoline insoluble fraction of the pitch is suspended in the fluid pitch, the insoluble solids can then be separated, for example, by the usual techniques of either sedimentation, centrifugation or filtration.

As will be readily appreciated, if filtration is the selected separation technique employed, a filter aid can be used if so desired to facilitate the separation of the fluid pitch from the soluble material suspended in the pitch.

The solid materials which are removed from the fluid pitch consist substantially of all of the quinoline insoluble materials such as coke and catalyst fines which were present in the pitch prior to heat soaking as well as those quinoline insolubles generated during heat soaking. The solid material removed during the separation step also contains small amounts of high softening quinoline soluble materials. Nonetheless, because of their significantly high softening points, these materials are undesirable in any feed to be used for carbon fiber production. Consequently, their removal at this stage is also particularly advantageous.

After separation of the solid material suspended in the fluid pitch, the fluid pitch is then treated with an anti-solvent preferably at ambient temperature. Thus, for example, in the case where filtration is used to separate the quinoline insoluble and other solid suspended matter from the fluid pitch, the filtrate is mixed with an organic liquid which is capable of precipitating at least a substantial portion of the pitch.

As will be appreciated, any solvent system, i.e. a solvent or mixture of solvents, which will result in the precipitation and flocculation of the fluid pitch can be employed in the practice of the present invention. However, since it is particularly desirable in the practice of the present invention to use that fraction of the pitch which is convertible into neomesophase, a solvent system particularly suitable in separating the neomesophase former fraction of the pitch from the remainder of the isotropic pitch is particularly preferred for precipitating the pitch.

Typically such solvent systems include aromatic hydrocarbons such as benzene, toluene, xylene and the like, and mixtures of such aromatic hydrocarbons with aliphatic hydrocarbons such as toluene-heptane mixtures. The solvents or mixtures of solvents typically will have a solubility parameter of between about 8.0 and 9.5 and preferably between about 8.7 and 9.2 at 25° C. The solubility parameter, $\gamma$, of a solvent or a mixture of solvents is given by the expression $$\gamma = \left(\frac{H_v TRT}{V}\right)^{\frac{1}{2}}$$

where $H_v$ is the heat of vaporization of the material, R is the molar gas constant, T is the temperature in degrees K, and V is the molar volume. In this regard, see, for example, J. Hildebrand and R. Scott, "Solubility of Non-Electrolytes", 3rd edition, Reinhold Publishing Company, New York (1949) and "Regular Solutions", Prentice Hall, New Jersey (1962). The solubility parameters at 25° for some typical hydrocarbons in commercial $C_6$ to $C_8$ solvents are as follows: benzene, 9.2; toluene, 8.9; xylene, 8.8; n-hexane, 7.3; n-heptane, 7.4; methyl cyclohexane, 7.8; and cyclohexane, 8.2. Among the foregoing solvents, toluene is preferred. Also, as is well known, solvent mixtures can be prepared to provide a solvent system with the desired solubility parameter. Among mixed solvent systems, a mixture of toluene and heptane is preferred, having greater than about 60 volume % toluene, such as 60% toluene/40% heptane, and 85% toluene/15% heptane.

The amount of anti-solvent employed will be sufficient to provide a solvent insoluble fraction which is capable of being thermally converted to greater than 75% of an optically anisotropic material in less than ten minutes. Typically, the ratio of organic solvent to pitch will be in the range of about 5 ml to about 150 ml of solvent per gram of pitch.

After precipitation of the pitch and particularly in the instances where the proper solvent system was used, separation of the neomesophase former fraction of the pitch can be readily effected by normal solid separation techniques such as sedimentation, centrifugation, and filtration. If an anti-solvent is used which does not have the requisite solubility parameter to effect separation of the neomesophase former fraction of the pitch, it will, of course, be necessary to separate the precipitated pitch and extract the precipitate with an appropriate solvent as described above to provide the neomesophase former fraction.

In any event, the neomesophase former fraction of the pitch prepared in accordance with the process of the present invention is eminently suitable for carbon fiber production. Indeed, the pitch treated in accordance with the present invention is substantially free from quinoline insoluble materials as well as substantially free from other pitch components which detrimentally affect the spinnability of the pitch because of their relatively high softening points. Importantly, the neomesophase former fraction of various pitches obtained in accordance with the practice of the present invention have softening points in the range of about 250° to about 400° C.

In addition to the batch process described hereinabove, the process of this invention is readily practiced in a continuous manner as will be described now with reference to FIG. 2.

Figure 2:
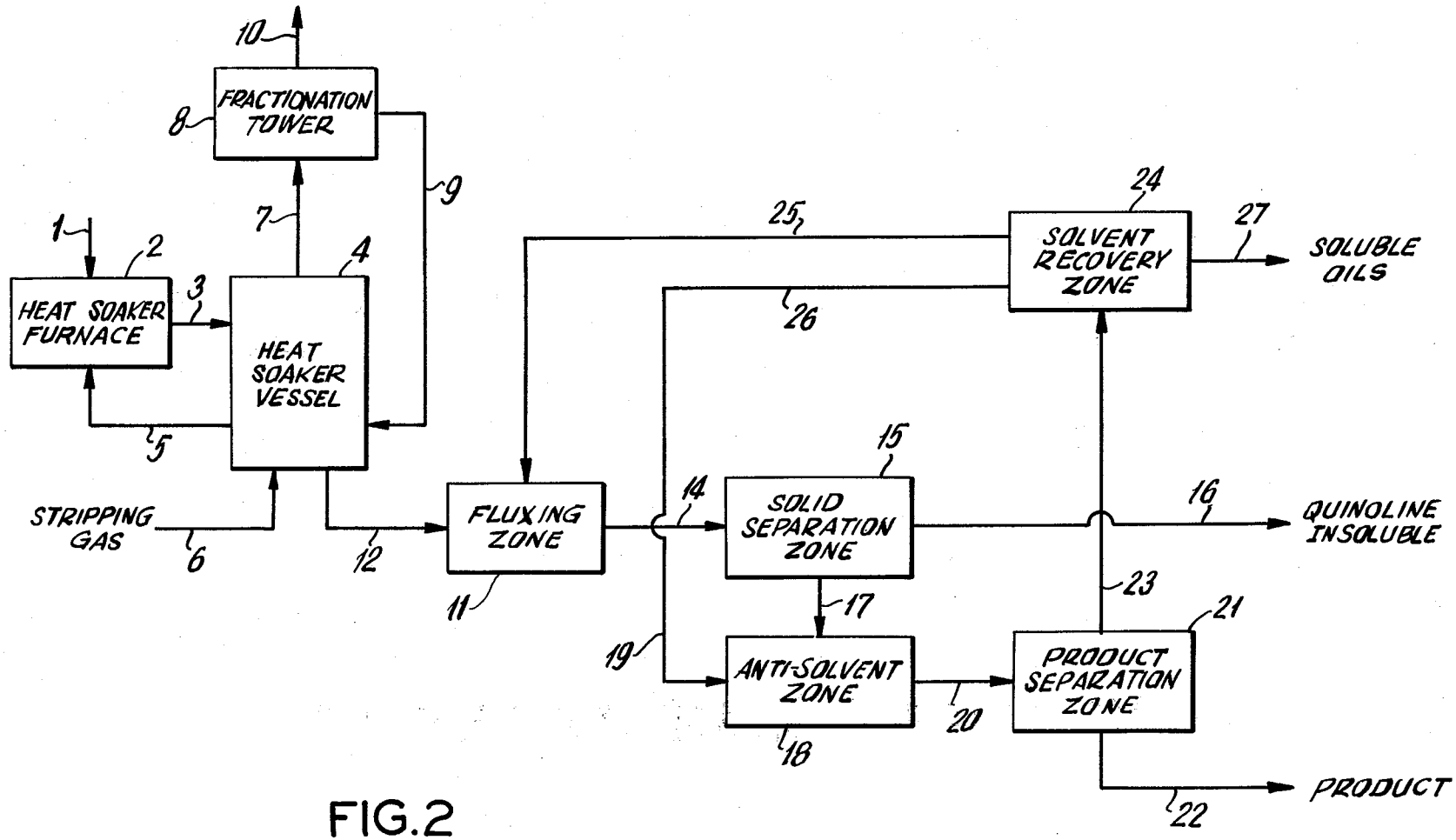
FIG. 2 is a schematic illustration of a continuous process for producing a feedstock eminently suitable for carbon fiber formation in accordance with the present invention.

As is shown in FIG. 2, a residue of petroleum origin such as distilled or cracked residuum of a petroleum pitch or other commercially available petroleum pitch is introduced via line 1 into heat soaker furnace 2 where it is heated, for example, at temperatures in the range of 350° C. to 450° C. Since it is preferred that the pitch be heated until at least samples of the heated pitch begin to show spherules that can be observed visually under polarized light at magnification factors of from 10× to 1,000×, additional heating of the pitch, as may be required, is provided in heat soaking vessel 4. Hence, the pitch is introduced into vessel 4 via line 3. As will be appreciated, some of the heated pitch can be recycled via line 5 from the heat soaker vessel 4 to the heat soaker furnace 2. Thus, pitch is continuously introduced and heat treated until spherules visible under polarized light begin to appear. In the event optionally gas stripping is to be employed, the stripping gas is introduced into the heat soaker vessel 4 via line 6. Volatile high boiling oils and the like present in the pitch or generated during the heat soaking of the pitch can be sent, e.g., via line 7, to a fractionation tower 8 and recycled via line 9 to the heat soaking vessel 4 for further heating and processing. In the event that the optional stripping gas is used to help remove volatile materials from the pitch, then fractionator 8 also serves to strip the stripping gas from the volatile portion of the pitch. Effluent from the fractionating tower can be removed via effluent line 10.

After heat soaking for the requisite time, the heat soaked product is introduced into the fluxing zone 11 via line 12 where it is mixed with the appropriate fluxing liquid.

After fluxing the pitch so as to provide a handleable liquid pitch with substantially all the quinoline insoluble fraction of the pitch suspended therein, the fluxed pitch is passed via line 14 to a separation zone 15 and the materials which are insoluble in the fluxed pitch are removed via line 16.

The fluid pitch, after removal of the solids, is sent, e.g., via line 14, to zone 15 and is passed via line 17 into the precipitation zone 18 wherein an anti-solvent is introduced, for example, via line 19.

After precipitation of the pitch, the so-precipitated material can be sent, for example, via line 20 into a solid product separation zone 21. Thus, the neomesophase former fraction, for example, can be removed via line 22 as a solid and the solvent such as the filtrate in the case of separation being effected by filtration can be sent via line 23 to a solvent recovery zone 24. The fluxing solvent recovered in zone 24 can be recycled via line 25 to mixing zone 11 and the anti-fluxing solvent recovered in zone 24 can be fed to mixing zone 18 via line 26. The remaining solvent soluble fraction of the pitch, such as solvent soluble oils, can be removed via line 27 and optionally is used as a feedstock for carbon blacks and the like.

A more complete understanding of the process of this invention can be obtained by reference to the following examples which are illustrative only and are not meant to limit the scope thereof which is fully disclosed in the hereinafter appended claims.

EXAMPLE 1

A commercially available petroleum pitch, Ashland 240, was ground, sieved (100 Taylor mesh size) and extracted with benzene at 28° C. in the ratio of one gram of pitch per hundred milliliters of benzene. The benzene insoluble fraction was separated by filtration and dried. The amount of neomesophase former fraction, i.e. benzene insoluble fraction, constituted only 7.8% of the entire pitch. A sample of the neomesophase former fraction was heated in the absence of oxygen at a rate of 10° per minute to a temperature of 350° C. After cooling, a polished sample of the heated pitch was examined under polarized light at a magnification factor of 500X and shown to have a microstructure indicative of greater than about 95% of an optically anisotropic phase.

EXAMPLES 2 to 4

In each of these examples, a commercially available Ashland 240 pitch was subjected to a heat soaking treatment by charging the pitch into a kettle which is then flushed with $N_2$ and evacuated at start. The heating times and temperatures after so charging are shown in Table I. After heating, the charge was recovered and pulverized in an inert atmosphere. Thereafter, samples of this heat treated pitch were extracted in accordance with the following procedure: a 125 ml Erlenmeyer bottom flask was charged with 5 grams of the pulverized heat soaked pitch and 5 grams of tetrahydrofuran. This mixture was agitated over 1 hour at ambient temperature and then filtered through a half micron millipore filter under a nitrogen atmosphere. The fluid pitch insoluble solid was weighed. The amount of quinoline insolubles in that fluid pitch insoluble fraction also was determined by the standard technique (ANSI/ASTM D2318-76) of extracting the insoluble fraction of the pitch with quinoline at 75° C.

The fluid pitch filtrate obtained from filtering the fluxed pitch was added to 20 grams of toluene and mixed therewith for 30–60 minutes. The resultant mixture was then filtered and the toluene insoluble neomesophase former fraction of the pitch was separated and dried in a vacuum oven at 100° C.

The softening range of a sample of each of the solvent insoluble neomesophase former fraction of the pitch was determined in $N_2$ blanketed, capped NMR tubes. Additionally, after heating to a temperature within their respective softening ranges, the heated pitch was examined under polarized light by mounting a sample on a slide with Permount, a histiological mounting medium sold by Fisher Scientific Company, Fairlawn, New Jersey. A slip cover was placed over the slide and by rotating the cover under hand pressure the mounted sample was crushed to a powder and evenly dispersed on the slide. Thereafter the crushed sample was viewed under polarized light at a magnification factor of 200X and the percent optical anisotropy was estimated. Samples of the neomesophase former fraction of the pitch also were spun into fibers. After spinning their optical anisotropy was determined. In all instances optical anisotropy was comparable to the sample prepared in Example 1.

The conditions and results of these foregoing experiments are set forth in further detail in Table I.

As will be appreciated from the foregoing, heat soaking of the pitch in accordance with the preferred embodiment of the present invention results in a substantial increase in the amount of neomesophase former fraction that is isolatable from the pitch. Additionally, fluxing the pitch after heat soaking renders the pitch sufficiently fluid so that it can pass through a half micron filter, thereby permitting the removal of undesirable insoluble fractions of the fluxed pitch. These insoluble fractions contain substantially all of the quinoline insoluble materials such as ash and the like which is normally present in the pitch as well as some relatively high melting substances generated during heat soaking.

EXAMPLES 5 to 13

In the following examples, the procedures of Examples 2 to 4 were followed, with the exception that the organic fluxing liquid and the anti-solvent liquid were varied as shown in Table II and the temperature of fluxing also was varied as shown. All samples showed greater than 75% anisotropy as determined by the techniques described in connection with Examples 2 to 4.

TABLE I

| Experiment No. | Heating Conditions | Tetrahydrofuran Insolubles, 1:1 THF/Fluxed Pitch | Wt. % QI | Wt. % Toluene Insolubles from Filtrate | Softening Range of Toluene Insolubles, °C. |
|---|---|---|---|---|---|
| 2 | 400° C./1 hr | .64 | .17 | 19.5 | 324–360 |
| 3 | 400° C./1 hr | 1.77 | .91 | 26.2 | 327–359 |
| 4 | 390° C./6 hr | 2.50 | 1.05 | 27.9 | 325–351 |

TABLE II

| Experiment No. | Heating Conditions | Flux | Fluxing and Filtering Conditions | Wt. % Insolubles in Fluxed Pitch | Anti-Solvent | Wt. % Anti-Solvent Insolubles | Softening Range, °C. |
|---|---|---|---|---|---|---|---|
| 5 | 400° C./1 hr | Tetrahydrofuran | Room Temp. | 0.64 | Toluene | 16.3 | 324–360 |
| 6 | 400° C./1 hr | Light Aromatic Gas Oil | 100° C. | 0.42 | Toluene/ heptane (85/15) | 22.0 | 325–360 |
| 7 | 400° C./1 hr | Heavy Aromatic Gas Oil | 150° C. | 0.41 | Toluene/ heptane (85/15) | 20.9 | 325–360 |
| 8 | 400° C./1 hr | Tetrahydrofuran | R.T. | 1.77 | Toluene | 20.8 | 327–359 |
| 9 | 400° C./1 hr | Light Aromatic Gas Oil | 100° C. | 1.08 | Toluene/ heptane | 27.0 | 325–350 |
| 10 | 400° C./1 hr | Heavy Aromatic Gas Oil | 150° C. | 0.89 | Toluene/ heptane | 25.5 | 325–350 |
| 11 | 390° C./6 hr | Tetrahydrofuran | R.T. | 2.50 | Toluene | 23.4 | 325–351 |
| 12 | 390° C./6 hr | Light Aromatic Gas Oil | 100° C. | 1.69 | Toluene/ heptane | 28.7 | 325–350 |
| 13 | 390° C./6 hr | Heavy Aromatic Gas Oil | 150° C. | 1.46 | Toluene/ heptane | 25.8 | 325–360° C. |

What is claimed is:

1. A process for treating carbonaceous graphitizable pitches comprising:

adding an organic fluxing liquid to a carbonaceous graphitizable pitch to provide a fluid pitch containing insoluble solids suspended therein, said solids including substantially all the quinoline insoluble solids present in the pitch, said organic fluxing liquid being added in an amount sufficient to lower to viscosity of the pitch whereby the fluid pitch is capable of flowing through a 0.5 micron filter with suction filtration;

separating said fluid pitch from said solids;

treating said separated fluid pitch with an organic liquid to precipitate at least a substantial portion of said pitch; and, separating the precipitated pitch from said organic liquid whereby a pitch free of quinoline insoluble solids is obtained.

2. The process of claim 1 wherein said carbonaceous graphitizable pitch is first heated at a temperature in the range of about 350° C. to about 450° C. at least for a time sufficient to result in the formation of spherules in said pitch which are visible under polarized light.

3. The process of claim 1 wherein said organic fluxing liquid is selected from the group consisting of tetrahydrofuran, light aromatic gas oils, heavy aromatic gas oils, toluene and tetralin.

4. The process of claim 3 wherein said organic fluxing liquid is employed in the range of about 0.5 to 3 parts by weight of liquid per part of pitch.

5. The process of claim 4 wherein the weight ratio of fluxing liquid to pitch is in the range of 1:1 to 2:1.

6. The process of claim 5 wherein said organic liquid and pitch are heated to a temperature in the range of about 60° to about 200° C.

7. The process of claim 6 wherein said solids suspended in said fluid pitch are separated from said fluid pitch by a technique selected from the group consisting of sedimentation, centrifugation and filtration.

8. The process of claim 7 wherein said solids are separated by filtration.

9. The process of claim 7 wherein said fluid pitch after separation of the solids is treated with an organic solvent system having a solubility parameter at 25° C. of between about 8.0 and about 9.5, said treating being at a temperature and with an amount of organic solvent system sufficient to provide a solvent insoluble fraction thermally convertible into a deformable pitch containing greater than 75% of an optically anisotropic phase.

10. A process for treating a thermal or cracked residuum of a petroleum origin capable of being thermally converted to an optically anisotropic phase comprising:

heating said residuum at temperatures in the range of from about 350° C. to about 450° C. at least until polarized light microscopic examination of samples of said heated residuum indicate the formation of optically anisotropic spherules therein;

terminating said heating and adding an organic fluxing liquid to said heated residuum to provide a fluid pitch containing insoluble solids suspended therein, said solids including substantially all the quinoline insoluble solids present in said heated residuum;

separating said solids from said fluid pitch;

treating said separated fluid pitch with an organic solvent system having a solubility parameter at 25° C. of between about 8.0 and about 9.5, said treating being at a temperature and with an amount of organic solvent system sufficient to provide a solvent insoluble fraction which is thermally convertible into a deformable pitch containing greater than 75% of an optically anisotropic phase; and, separating said solvent insoluble fraction from said solvent system.

11. The process of claim 10 wherein said organic fluxing liquid is one which in the range of from about 0.5 parts by weight of liquid per part of pitch to about 3 parts by weight of liquid per part of pitch renders said pitch sufficiently fluid to pass through a 0.5 micron filter.

12. The process of claim 11 wherein said organic fluxing liquid is selected from the group consisting of tetrahydrofuran, toluene, light aromatic gas oils, heavy aromatic gas oils and tetralin.

13. The process of claim 12 wherein separation of said solids is effected by filtration.

14. The process of claim 13 wherein said fluxing liquid is tetrahydrofuran and said filtration is conducted at ambient temperature.

15. The process of claim 13 wherein said fluxing liquid is selected from toluene, tetralin, light aromatic gas oils and heavy aromatic gas oils and said filtration is conducted at elevated temperatures.

16. In the process of preparing an isotropic carbonaceous graphitizable feedstock for carbon fiber production by extracting an isotropic carbonaceous pitch with an organic solvent system having a solubility parameter at 25° C. of between about 8.0 and 9.5 to provide a solvent insoluble carbon fiber feedstock which is separated from said solvent system, the improvement comprising: first adding a fluxing liquid to said isotropic carbonaceous pitch to provide a fluid pitch having separable quinoline insoluble solids suspended therein, said fluxing liquid being added in an amount sufficient to lower the viscosity of the pitch so that the pitch is capable of flowing through a 0.5 micron filter with suction filtration; separating said quinoline insolubles from said fluid pitch and thereafter treating said fluid pitch with said organic solvent system to precipitate a solvent insoluble carbon fiber feedstock and separating said feedstock from said organic solvent system, whereby a feedstock eminently suitable for carbon fiber formation is obtained.

* * * * *